United States Patent [19]

Giepen

[11] Patent Number: 4,501,349

[45] Date of Patent: Feb. 26, 1985

[54] MANUALLY OPERABLE MULTI-COIN MECHANISM

[76] Inventor: Hubert M. Giepen, 1404 E. Business 83, Mission, Tex. 78572

[21] Appl. No.: 466,149

[22] Filed: Feb. 14, 1983

[51] Int. Cl.[3] ..... G07F 5/08

[52] U.S. Cl. ..... 194/1 G; 194/55

[58] Field of Search ..... 194/55-57, 194/92, 93, 102, 1 G, DIG. 2

[56] References Cited

U.S. PATENT DOCUMENTS 2,020,148 11/1935 Leggett ..... 194/92

2,116,309 5/1938 Gorton ..... 194/92 X

*Primary Examiner*—Stanley H. Tollberg

*Attorney, Agent, or Firm*—Georges A. Maxwell

[57] ABSTRACT

A coin mechanism comprising a frame structure mounted in a wall panel of a related vending machine, an elongate, flat, horizontal actuating bar carried by the frame and shiftable from a forward position to a rear position and having a manually engageable front end accessible at the front of the machine and a rear end within the machine and engageable with a product dispensing device therein. The bar has laterally spaced vertically opening longitudinally extending coin receiving openings in its central portion normally positioned forward of the panel and movable rearward thereof when the bar is moved rearward. The frame has laterally spaced longitudinally extending upwardly and rearwardly opening coin-receiving grooves beneath the central portion of the bar to receive the lower halves of coins engaged in and through the openings in the bar. The frame carries a plurality of longitudinally extending latch arms above the bar and rear portions of the grooves. The front ends of the latch arms are pivotally carried by the frame and the rear ends thereof are formed with heads with stop shoulders. The heads on the arms are shiftable longitudinally between a pair of vertically spaced stops carried by the bar when the arms are pivoted vertically to intermediate positions and establish stop engagement with the stops and limit rearward shifting of the bar when they are pivoted vertically to upper and lower positions. Springs normally hold the arms in their lower positions and each arm carries a coin-engaging block that occurs above the rear portion of its related groove in the frame.

18 Claims, 29 Drawing Figures

MANUALLY OPERABLE MULTI-COIN MECHANISM

This invention has to do with an improved coin mechanism for vending machines.

BACKGROUND OF THE INVENTION

It is common practice to merchandise many products by means of coin-operated vending machines. Such machines are to vend candy, cigarettes, beverages, newspapers, insurance policies and substantially any and all other items which are of a size and nature that they can be advantageously handled and dispensed by those various product handling devices which have been developed and are used in vending machines and the cost of which does not exceed the coinage receiving capacity of the vending machines.

All coin-operated vending machines include coin mechanisms, that is, mechanisms adapted to received required coinage for operation of the machines and which, as a general rule, operate to normally lock the machines against operation and which operate to release and effect operation of the machines when required coinage is deposted therein.

The most common type of coin mechanisms for vending machines are characterized by elongate, horizontal, axially shiftable coin-receiving transport bars carried by coin mechanism frames mounted in openings in the front walls of their related vending machines. The transport bars have front end portions with one or more coin-receiving apertures therein. The noted bars usually project freely forwardly from their related frames and machines and have thumg-engaging portions at their forward ends to facilitate manual shifting thereof. The other or rear ends of the bars occur within their related machines and engage product handling and dispensing devices within the machines and which are such that upon rearward axial shifting of the bars, the product dispensing devices are actuated. The coin-receiving apertures in the bars are normally accessible at the front of their related vending machines and the noted frames of the mechanisms carry various coin handling means and latching means which operate to permit rearward movement of the bars from their normal front position to their rear actuated positions, when required coinage is engaged with and carried by the bars.

While the above noted type of coin mechanisms are rather simple in nature, the operating mechanisms thereof are characteristically rather complicated and the overall cost of manufacturing and maintaining those mechanisms is quite high.

Still further, while many of the prior art coin mechanisms in current use are such that they can handle a number of several different sizes of coins, for example, one or more nickels, dimes or quarters, and are such that they can be adjusted or modified to handle different combinations of such coins, the range of combinations of coins they can be made to handle is rather limited and in most cases, is such that the aggregate value of coins they can be made to handle is less than the sale price of many items that might be sold in the vending machines with which they are related.

As a result of economic inflation, the cost of an ever-increasing number of items regularly sold in vending machines is exceeding the coinage-receiving capacity of the coin mechanisms with which the machines are equipped. Accordingly, the operators of those vending machines are confronted with the problems and cost of replacing the existing coin mechanisms of their machines with new coin mechanisms which will receive and handle more coinage. Further, the manufacturers of new vending machines (in anticipation of continuing economic inflation) are equipping their machines with coin mechanisms designed to receive greater amounts of coinage than were used in past years. The coin mechanisms for handling larger amounts of coinage are, as a general rule, no more than larger, more complicated, and more costly embodiments of the smaller or lower capacity coin mechanisms of the past. Accordingly, the cost of replacing old low capacity coin mechanisms on existing vending machines with new large capacity coin mechanisms is very costly and the cost of new vending machines equipped with large capacity coin mechanisms has been noticeably increased by the inclusion of said large capacity coin mechanisms.

As a result of the foregoing, there is a present and rapidly increasing need for new inexpensive large capacity coin mechanisms whereby operators of existing vending machines can replace the existing below capacity coin mechanisms in their machines with large capacity coin mechanisms at a reasonable cost. There is also a basic need and want in the vending machine art for new coin mechanisms which are less costly than are those coin mechanisms provided by the prior art, regardless of their coin capacity and for new mechanisms which are not necessarily more costly, as their coin handling capacity increases.

OBJECTS AND FEATURES OF THE INVENTION

It is an object of my invention to provide a novel coin mechanism for coin-operated vending machines which is simple and inexpensive to make and which is such that it can be made to handle a wide range of coinage without costly and/or complicated modifications thereof.

It is an object of the invention to provide a coin mechanism of the character referred to which can be advantageously engaged in existing vending machines in place of preexisting coin mechanisms, to change the coin receiving capacity of the machines.

Yet another object of the invention is to provide a new coin mechanism for vending machines which is substantially less expensive than comparable or equivalent coin mechanisms provided by the prior art whereby the cost of new vending machines with my new coin mechanism can be reduced.

It is an object and feature of the invention to provide a new coin mechanism which includes a novel elongate axially shiftable coin transport bar, novel latch means releasably engageable with the bar to limit axial shifting thereof and novel caliper means to cooperatively engage a coin or coins transported by the bar, to effect operation of the latch means and permit full actuation of the bar when predetermined proper coinage is engaged therewith.

Another object and feature of my invention is to provide a coin mechanism of the character referred to wherein the transport bar is a substantially flat horizontal part with one or more elongate, axially extending vertical coin accommodating slots or openings defining axially forwardly and axially rearwardly disposed, coin engaging edges to engage forwardly and rearwardly disposed edges of a coin or coins engaged through the slots or openings with their flat planes arranged vertically and parallel with the axis of the bar whereby the coins are transported with the bar upon axial shifting thereof.

It is another object and feature of the present invention to provide a coin mechanism of the character referred to wherein the latch means includes one or more elongate latch arms with front ends pivotally mounted above the bar on a horizontal transverse axis rearward of the slot or opening in the bar, upper and lower stop bars carried by the transport bar normally spaced forward of the rear ends of the latch arm or arms and upper and lower forwardly disposed latch shoulders on the rear ends of the arm or arms to engage the upper and lower stop bars when the arm or arms are pivoted rearwardly and upwardly or rearwardly and downwardly from a central or intermediate pivotal disposition whereby rearward shifting of the transport bar is stopped and limited when the arm or arms are in other than their said intermediate positions.

Yet another object and feature of the invention is to provide a coin mechanism of the character referred to wherein the caliper means includes one or more longitudinally extending upwardly and rearwardly opening lower coin transfer troughs extending below the central portion of the transport bar to cooperatively receive the lower portions of coins transported rearwardly by the transport bar and a caliper block with a longitudinally extending and downwardly and axially opening coin transfer groove in spaced relationship above the rear portion of each trough and carried by the forward end of a related latch arm to engage the upper portion of coins transported rearwardly therethrough by the transport bar and operating to pivotally move the latch arm to its intermediate pivotal position when the size of a coin engaged in and between said trough and channel is of proper predetermined size.

Yet another object of the invention is to provide a coin mechanism of the general character referred to above wherein the coin transfer grooves and channels are vertically adjustable relative to each other whereby the mechanism can be adjusted to effectively handle different size coins.

Still another object of the invention is to provide a coin mechanism of the character referred to wherein said coin receiving troughs have laterally upwardly and outwardly divergent coin edge engaging surfaces and said grooves have laterally downwardly and outwardly divergent coin edge engaging surfaces whereby the caliper means operates to effectively measure the thickness as well as the diameter of coins engaged thereby.

Another object and feature of the invention is to provide a coin mechanism of the character referred to including stop means to prevent forward movement of the transport bar after the latch means has released the bar and before said bar is fully actuated and to stop axial rearward movement of the transport bar upon movement thereof from its fully actuated position to its normal forward position.

It is an object and feature of my invention to provide a coin mechanism of the character referred to which includes a coin orienting part above the forward portion of the transport bar to guide coins into the openings in the bar, into related troughs below the bar and to maintains the coin properly oriented to engage in the grooves of the caliper blocks upon rearward movement of said coins in and through the mechanism.

Finally, it is an object of my invention to provide a coin mechanism of the character referred to which is made up of a few easy and economical to make and assemble parts.

The foregoing and other objects and features of my invention will be apparent and fully understood from the following detailed description of one preferred form and embodiment of the invention, throughout which description reference is made to the accompanying drawings:

DETAILED DESCRIPTION OF THE INVENTION

Figures 1, 2, 3, 4:
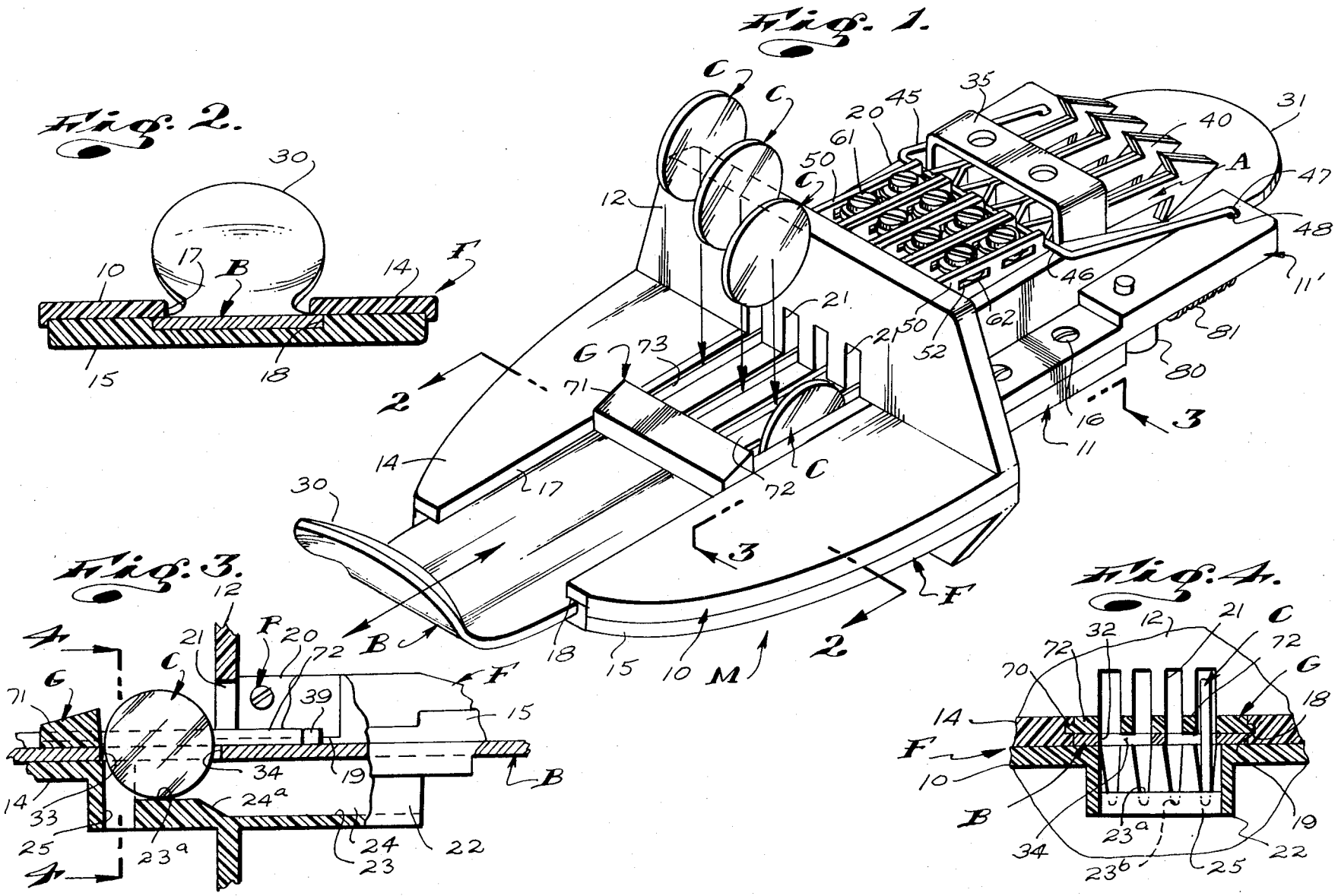
FIG. 1 is an isometric view showing the top, front and one side of my coin mechanism.
FIG. 2 is a view taken as indicated by line 2—2 on FIG. 1.
FIG. 3 is a sectional view taken substantially as indicated by line 3—3 on FIG. 1.
FIG. 4 is a sectional view taken as indicated by line 4—4 on FIG. 3.
Figures 5, 6, 7, 8, 9, 10, 11, 12, 13, 14, 15, 16:
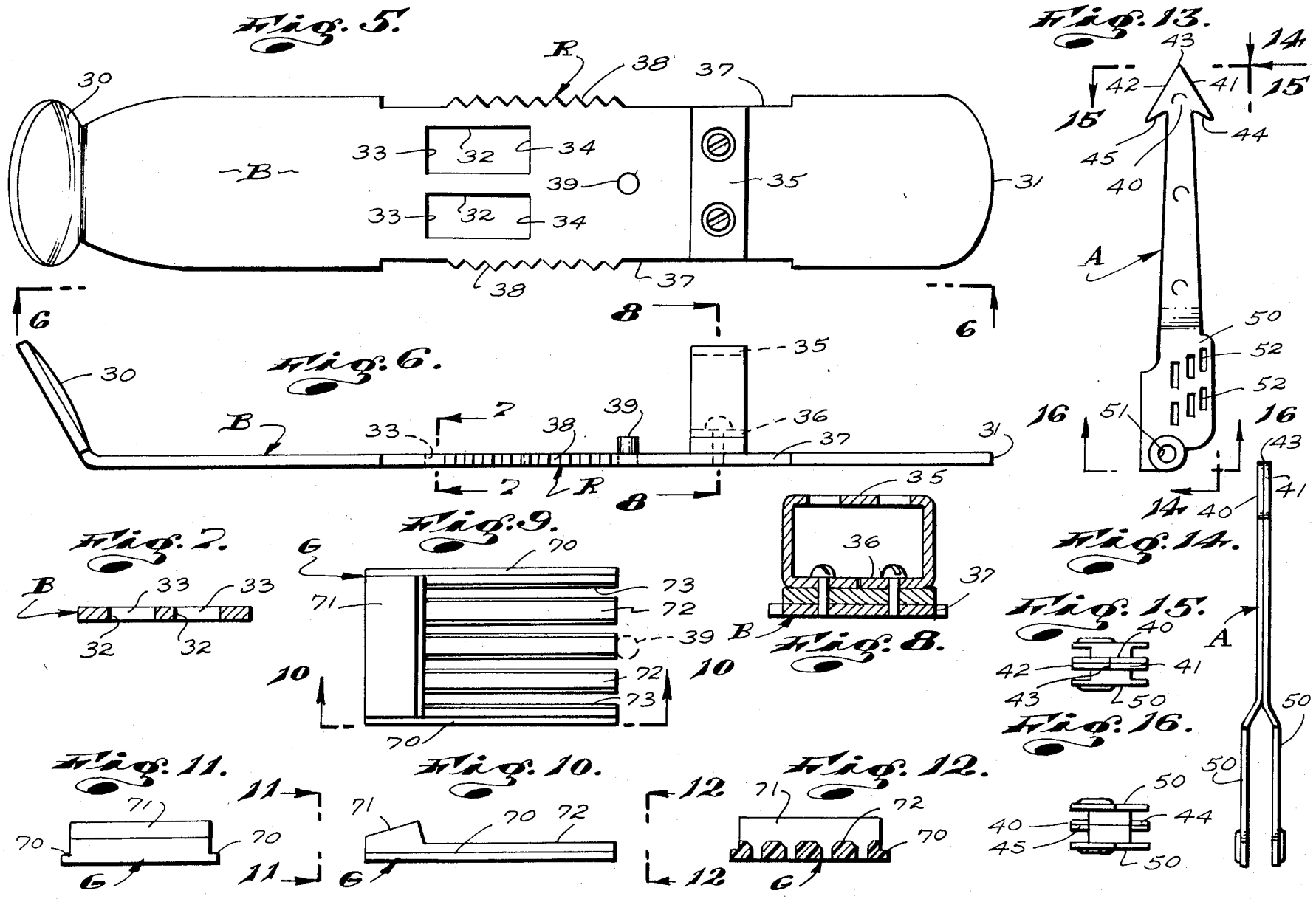
FIG. 5 is a top plan view of the coin transport bar.
FIG. 6 is a view taken as indicated by line 6—6 on FIG. 5.
FIG. 7 is a view taken as indicated by line 7—7 on FIG. 6.
FIG. 8 is a view taken as indicated by line 8—8 on FIG. 6.
FIG. 9 is a top plan view of a part of the mechanism.
FIG. 10 is a view taken as indicated by line 10—10 on FIG. 9.
FIG. 11 is a view taken as indicated by line 11—11 on FIG. 10.
FIG. 12 is a view taken as indicated by line 12—12 on FIG. 10.
FIG. 13 is a side view of the latch arm.
FIG. 14 is a view taken as indicated by line 14—14 on FIG. 13.
FIG. 15 is a view taken as indicated by line 15—15 on FIG. 13.
FIG. 16 is a view taken as indicated by line 16—16 on FIG. 13.

Referring to FIG. 1 of the drawings, the coin mechanism M that I provide includes an elongate chassis or frame F with flat horizontal front and rear end portions 10 and 11 and a flat vertical central mounting flange 12. In normal installations of the mechanism M, the rear end portion 11 is engaged through an opening in a vertical front wall (not shown) of a related vending machine cabinet. The rear portion 11 projects rearwardly from the wall of the cabinet into the interior of the cabinet and onto working proximity with a product dispensing device for the vending machine. The mounting flange 12 overlies the opening in the front wall to abutt the front surface thereof and is screw-fastened to that wall by means of screw fasteners engaged through the wall and thence into the flange 12, from within the cabinet (not shown).

Since the vending machine with which the mechanism M might be related is not a part of and does not affect the novelty of my invention, and since the manner in which the mechanism is related to such a machine is common and well-known to those in the art, the foregoing description of how the mechanism might be mounted is sufficient and further illustration and description thereof can and will be dispensed with.

The frame F is made up of two parts, there being a top part 14 and a bottom part 15. The parts 14 and 15 are, in the preferred form of the invention, established of a suitable plastic material and are formed by injection molding.

Figures 17, 18, 19, 20, 21, 22, 23:
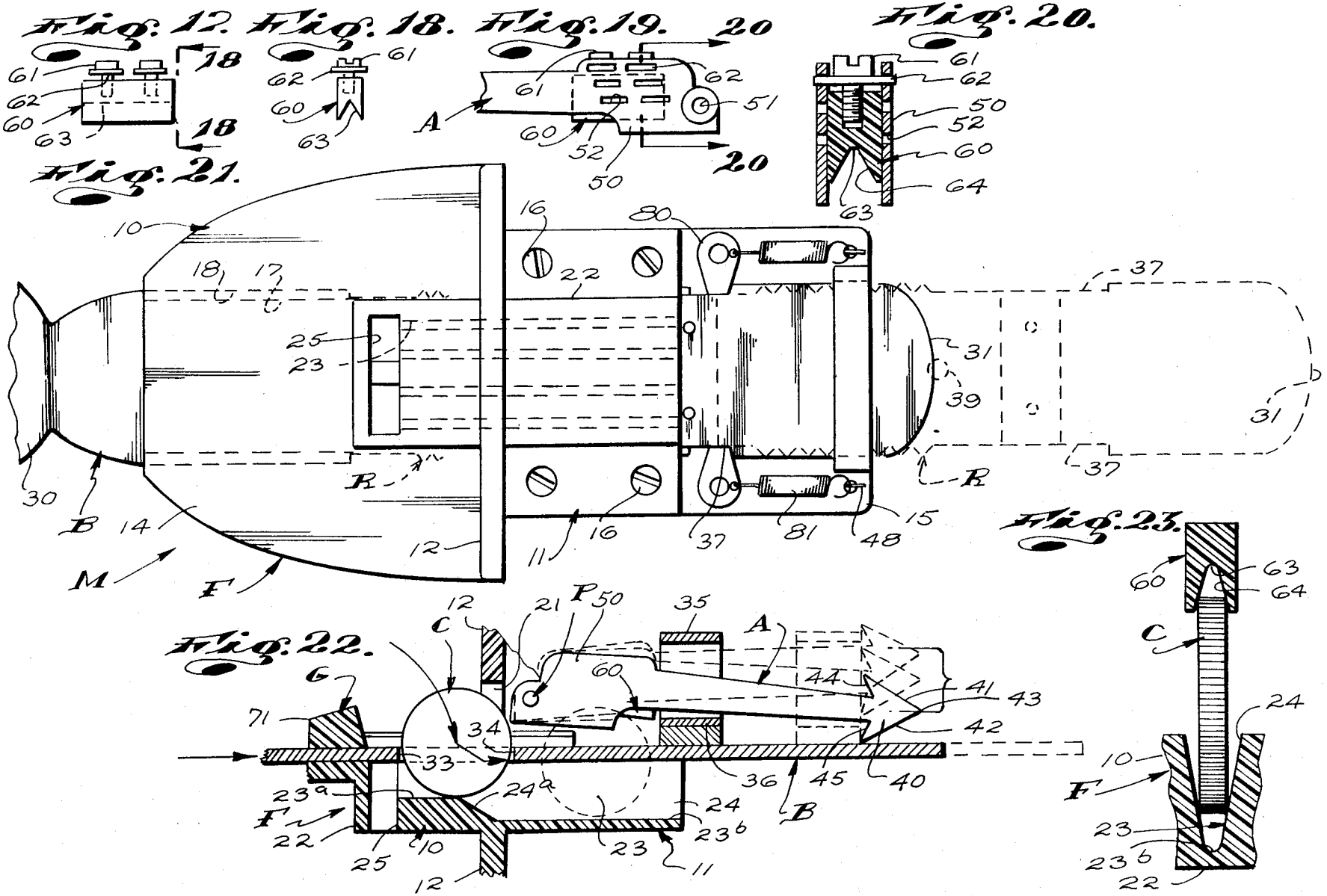
FIG. 17 is a side view of a caliper block.
FIG. 18 is a view taken as indicated by line 18—18 on FIG. 17.
FIG. 19 is a view similar to FIG. 17 showing the block engaged in a related latch arm.
FIG. 20 is an enlarged cross-sectional view taken as indicated by line 20—20 on FIG. 19.
FIG. 21 is a bottom plan view of the mechanism.
FIG. 22 is a diagrammatic view of a portion of the construction with parts shown in cross-section and with parts shown in different positions by phantom lines.
FIG. 23 is an enlarged detailed sectional view of a portion of the construction.

The parts 14 and 15 are fastened together by, for example, four screw fasteners 16 (see FIG. 21).

The parts 14 and 15 of the frame F are formed and cooperate to define the noted front and rear portions 11, the flange 12, and define a longitudinally extending upwardly and axially opening central channel 17 with longitudinally extending laterally inwardly opening retaining grooves 18 at its opposite sides. The frame further defines a pair of longitudinally extending laterally inwardly opening secpmdaru retaining grooves 19 which grooves occur above the grooves 18. The grooves 19 are of limited longitudinal extent and open into the portion of the channel 17 immediately forward and rearward of the flange 12.

The top part 14 of the frame has a pair of laterally spaced longitudinally extending upwardly projecting vertical walls 20 at and extending up from the opposite sides of the channel 17 rearward of the flange 12.

The rear end portion of the top part 14 is greater in longitudinal extent than the rear portion of the bottom part 15 and projects freely rearwardly therefrom as indicated at 11'.

The upper portion of the flange 12 defined by the top part 14 is provided with one or a plurality of laterally spaced forwardly, rearwardly and downwardly opening vertically extending slot-like coin accommodating notches 21. The notches 21 occur above the channel 17 with their lower open ends communicating with said channel. In the case illustrated, four coin accommodating notches 21 are provided.

The bottom part 15 of the frame F is formed with what will be called a coin receiving block 22. The block 22 occurs below the channel 17 and extends limited distances forward and rearward of the central flange 12.

The block 22 is formed with a plurality of elongate laterally spaced vertically and rearwardly opening coin receiving troughs 23. The troughs 23 have laterally upwardly and outwardly inclined coin edge engaging surfaces 24. In the case illustrated, there are four troughs 23, each occurring below a related coin accommodating notch 21 in the flange 12.

In the preferred carrying out of the invention and as shown, the forward end of the block 22 has a vertical cleanout opening 25. The front end portions $23^A$ of the bottoms of the troughs 23, forward of the flange 12, occur above the rear end portions $23^B$ of the bottoms of said troughs occurring rearward of the flange 12 and the forward and rear portions of the bottoms of the troughs are joined by central downwardly and rearwardly inclined ramps $24^A$. The forward elevated portions 24 of the bottoms of the troughs serve to hold coins deposited therein, up and in a manually accessible position forward of the flange 12, as coins are deposited in the mechanism and preparatory to actuation thereof.

In practice, the open rear ends of the troughs 23 open within the interior of a related vending machine cabinet and a coin receptacle (not shown) can be arranged below them to receive and collect coins discharged therefrom.

The form, design and details of construction of the frame F, illustrated and described above, can be modified and varied to a considerable extent without affecting or departing from the essence and spirit of my invention.

The mechanism M next includes an elongate, flat, horizontal coin transport bar B. The bar B is greater in longitudinal extent than the frame and is slidably engaged in the channel 17. The bar has opposite side edges which engage in the retaining grooves 18 at the opposite sides of the channel 17 to guide and prevent vertical displacement of the bar relative to the frame.

The front end portion of the transport bar B normally projects forwardly from the channel 17 and from the front end of the frame F. In accordance with common practice, the front end of the bar is provided with an upwardly turned manually engageable thumb pad 30 to facilitate manual axial shifting of the bar in and relative to the frame F.

The rear end 31 of the transport bar B projects rearwardly from the rear end of the frame F and normally serves to engage and effect operation of a related product transporting and dispensing device (not shown) in the vending machine with which the mechanism A is related. In accordance with common practice, the bar B effects operation of its related dispensing device upon manual rearward shifting of the bar B to and beyond a predetermined distance rearward of the rear end of the frame F.

The bar B is next characterized by one or more central vertical openings 32 which define longitudinally spaced rearwardly and forwardly disposed coin edge engaging driving edges 33 and 34. In practice, a separate slot-like opening 32 might be provided to occur above each trough 23 in the block portion 22 of the frame F; a single opening might be provided to establish the required edges 33 and 34; or as shown, a pair of openings 32 can be provided to establish the noted and required edges.

The openings 32 are positioned in the bar B to occur forward of the flange 12 and above the forward end portions of the troughs 23 when the bar B is in its normal forward position, as shown in the drawings. The openings 32 are such that upon rearward shifting of the bar B form its normal forward position towards and near to its rearmost position, its forward coin driving edges will drive and transport coins engaged therethrough, through their related troughs 23 and out from the open rear ends thereof.

The bar B next includes a pair of vertically spaced transversely extending upper and lower stop bars 35 and 36. The stop bars 35 and 36 are positioned above the rear end portion of the transport bar B in rearward spaced relationship from the openings 32 and from the vertical flange 12 of the frame, when the transport bar is in its normal forward position. The stop bars 35 and 36 can, as shown, be advantageously defined by the top and bottom transversely extending sides of a rectangular metal frame screw-fastened to the top surface of the bar B. Apparent alternative methods and structures that might be provided to establish the stop bars 35 and 36 or equivalent stop means are numerous and need not be illustrated and described.

The transport bar B next includes an elongate longitudinally extending recess 37 throughout a central portion of each of its opposite side edges. The central portion of each of said recesses 37 is formed with a longitudinal series of cam engaging ratchet teeth 38.

Finally, the transport bar B is provided with an upwardly projecting drive pin 39 forward of the stop bars 35 and 36. The purpose of said stop pin will be described in the following.

The coin mechanism M next includes one or a plurality of elongate laterally spaced longitudinally extending latch arms A. The arm or arms A are positioned above the bar B and above the rear end portions of related coin troughs 23 in the frame F. The forward ends of the arms A are pivotally carried by a transversely extending axle pin P, which pin is engaged with and extends between the walls 20 of the frame F, immediately rearward of the flange 12 and which is in vertical spaced relationship above the transport bar B.

The rear ends of the latch arms A are formed with stop bar engaging or latching heads 40. The heads 40 are less in vertical extent than the vertical space between the stop bars 35 and 36 and are of arrowhead shape with rearwardly convergent cam surfaces or edges 41 and 42, which converge to define pointed rear ends 43 on the arms and which define upper and lower forwardly disposed vertical stop bar engaging shoulders 44 and 45.

The latch arms A are of substantial longitudinal extent and are such that they extent between the stop bars 35 and 36 and normally terminate a limited predetermined distance rearward of the stop bars 35 and 36. The distance between the heads 40 on the arms A and the stop bars 35 and 36 is such that the shoulders 44 and 45 of the heads 40 will engage the bars 35 and 36 when the transport bar B is moved rearwardly from its normal forward position to a position where it advances coins into the rear portion of the troughs 23 and will stop further rearward movement of the transport bar and rear movement of the coins from engagement in the troughs 23. If, and only if, each of the several arms A are pivoted to a mean or central position in their arc of movement, where the heads 40 will move freely between the stop bars 35 and 36, can the transport bar B move further axially rearwardly (so that the stop bars 35 and 36 move rearwardly past and from the rear headed ends of the arms).

After the stop bars 35 and 36 have been moved rearward from the rear ends of the arms A and upon subsequent forward movement of the transport bar B and the stop bars 35 and 36, the inclined edges 41 and/or 42 of the heads 40 on the arms A cam or ride substantially freely over the bars 35 and/or 36 whereby free forward movement of the bar B from its fully actuated rear position to its forward normal position is not interfered with or prevented.

The coin mechanism M next includes a rat-trap type spring 45 with a transversely extending base 46 engaging the upper rear end portions of the arms A. The spring 45 has side legs 47 extending rearwardly and downwardly from the ends of the base 46 and which are formed with downwardly turned anchoring posts 48. The anchoring posts 48 are engaged through vertical openings in the rear end portion of the frame. The spring 45 is biased to normally yieldingly urge and hold the rear ends of the cam arms down, with the edges or shoulders 45 on the heads 40 thereof positioned to engage the lower stop bar 36 on the transport bar B.

While other suitable spring means might be substituted for the spring 45, illustrated and described above, the spring 45 is believed to be as simple and inexpensive a means as can be provided and is preferred.

In the form of the invention illustrated, the latch arms A are fabricated of a pair of stamped sheet metal parts spot-welded together and are formed to establish the above described heads 40 at the rear ends of the arms and to establish a pair of laterally spaced vertical side walls 50 at the front ends of the arms. The side walls 50 have aligned axle shaft receiving openings 51 formed therein and are preferably formed with a plurality of longitudinally and vertically spaced sets of registering fastener flange receiving apertures or slots 52, as clearly shown in the drawings.

The coin mechanism M next includes cam engaging caliper blocks 60 engaged between the laterally spaced side walls 50 of the latch arms A. The blocks 60 carry and/or are carried by a pair of flanged screw fasteners 61. The fasteners 61 project upwardly from the tops of the blocks with their flanges 62 engaged in related pairs of aligned slots 52 in their related arms A, as clearly shown in FIGS. 19 and 20 of the drawings. The blocks 60 are suitably retained within the forward ends of the arm A and their vertical positioning relative to the arms and to their related troughs 23 can be adjusted by advancing the screw fasteners 61 up or down in the blocks, as circumstances require.

The block 60 carried by each arm A occurs in predetermined vertical spaced relationship above the rear end portion of its related trough 23 in the frame F and has an elongate longitudinally extending groove 63 to cooperatively receive and accommodate the upper portion of coins transported relative thereto. The groove 63 has laterally downwardly and outwardly divergent coin edge engaging surfaces 64. In operation, when a coin C of predetermined diameter and thickness is transported by the transport bar B into engagement in and between a related trough 23 and groove 63, the coin operates to elevate and/or pivot the lever arm A related to the block 61, against the resistance of the spring 45, to that central position where the head 40 of the arm A will not engage the stop bars 35 and 36 and so that the bar B can be moved rearwardly to its fully actuated position and the coin can be advanced to discharge from the trough 23. If a coin of improper size is engaged in the mechanism M and advanced between a related trough and the groove 63 of a related block 60, it will either fail to pivot and elevate the head 40 of its related latch arm A sufficiently to clear the lower stop bar 36 or will elevate the arm to an extent that the upper stop bar 35 will not clear the head.

Accordingly, it will be apparent that to effect operation of the mechanism A from its normal forward position to its fully actuated rear position, proper coins must be engaged in each of the troughs 23 and advanced rearwardly through the mechanism so that each and all of the latch arms A are moved to their intermediate positions. If any one of the coins is the wrong size, the arm A with which it is related will engage one of the stop bars 35 or 36 and prevent further and complete operation of the mechanism to its fully actuated position.

If coins of different denomination or size are to be handled, the caliper blocks 60 can be raised or lowered to properly engage larger or smaller coins, by engaging the flanges 62 of the fasteners 61 in suitably vertically positioned sets of slots or apertures 52 in their related side walls of their related arms.

The forward portions 23$^{A}$ of the troughs 23 are elevated and such that they engage and hold the smallest coins, such as dimes, up forward of the flange 12 so that a person seeking to operate the mechanism can manually engageable and remove the coins, if desired.

Accordingly, the elevated forward end portions 23$^{A}$ of the trough 23 and the vertical positioning and the vertical adjustability of the caliper blocks 60 create that relationship of parts which enables the mechanism to effectively handle different size coins.

In addition to the above, the coin mechanism M can and is shown provided with a coin receiving and orienting gate G above the transport bar B to overlie the openings 32 in said bar and to direct coins introduced into the mechanism into proper alignment and engagement in the troughs 23 and into proper aligned and engaged relationship in the grooves 63 in the caliper blocks 60.

The gate G is a flat horizontal rectangular part which can be advantageously molded of a plastic material. The gate G is slidably engaged in the channel 17 of the frame F atop the transfer bar B. The gate G has flanges 70 at its opposite sides in retained axial sliding engagement in the retaining grooves 19 in the frame F, which grooves occur above the grooves 18 for the bar B. The gate G has a transversely extending header 71 at its forward end and has a plurality of laterally spaced elongate, horizontal rearwardly projecting fingers or tines 72 which are arranged to extend rearwardly on vertical longitudinal planes between adjacent troughs 23 and at the outsides of the outside troughs 23 The tines cooperate to define vertical longitudinally extending coin receiving and orienting slots 73. Adjacent tines extend across the opposite faces of coins related thereto when the lower edges of the coins are supported in their related troughs 23 and thereby hold the coins in vertical planes with their upper edge portions properly disposed and positioned for rearward movement into cooperative engagement in the grooves in their related caliper blocks 60. In operation, the gate G frictionally engages and is moved rearwardly with the transport bar when that bar is moved rearwardly. The rear ends of the tines occur on horizontal planes below the forward end portions of the latch arms A and project rearwardly beyond the side walls 20 of the latch arms whereby its header 71 stops at the front face of the flange 12 of the frame F, during rearward movement of the transport bar B from its normal forward toward its fully actuated rear position.

(But for the fact that the required travel for the gate G is materially less than the travel of the transport bar B, the gate G might be fixed to the bar B).

So as to assure return of the gate G to its normal forward position, the above noted drive pin 39 on the bar B is provided. Upon forward movement of the bar B from its fully actuated position to its formal forward position, the pin 39 engages the rear end of one of the tines and moves the gate G back to its normal forward position.

Figures 24, 25, 26, 27, 28, 29:
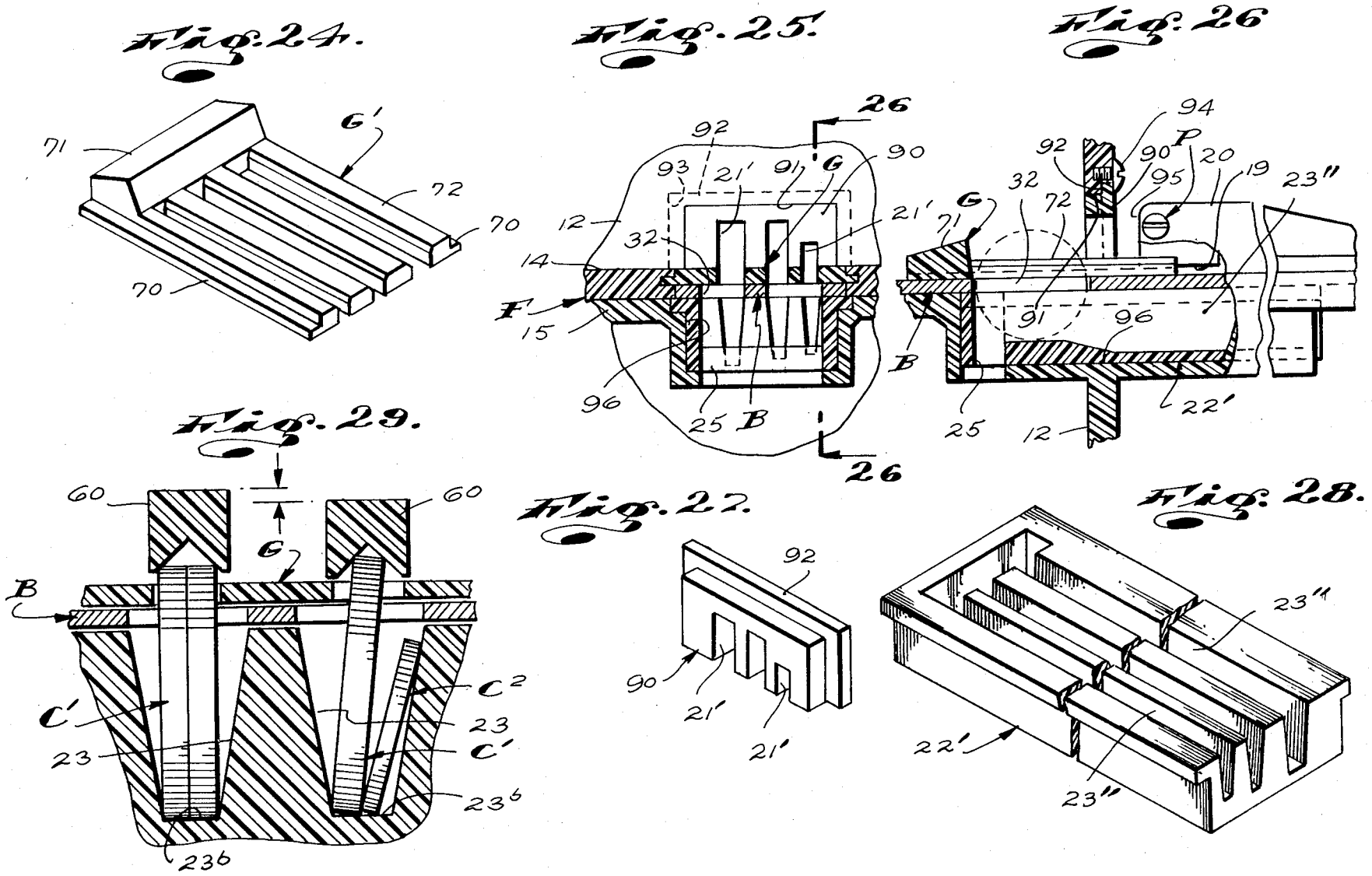
FIG. 24 is an isometric view of a modified form of one part.
FIG. 25 is a view similar to FIG. 4 showing another form of the invention.
FIG. 26 is a view taken as indicated by line 26—26 on FIG. 25.
FIGS. 27 and 28 are isometric views of part os the structure shown on FIGS. 25 and 26.
FIG. 29 is an enlarged diagrammatic view showing parts proportioned to accommodate pairs of coins.

In practice, if it is desired to reduce the number of coins required to actuate the mechanism M, a special gate G′, such as shown in FIG. 24 of the drawings, can be provided. The gate G′ distinguishes from the gate G by making one or more of its tines sufficiently great in lateral extent to overlie and to block the open top of a predetermined trough 23 and to underlie its related lever arm A and caliper block 60. In essence, the gate G′ is similar to the gate G but has the space between selected adjacent pairs of tines filled in. The upper surface of the joined together or broad tine is such that it engages the lower edges of the side walls 20 of the lever arms A when it is moved rearwardly relative to the arm and is such that it pivots and elevates that arm A to its intermediate position. Accordingly, the special gate G′ overlies and blocks one or more of the coin receiving troughs 23 and is such that it operates the latch arm or arms A related to those troughs to their intermediate position during actuation of the mechanism M. Accordingly, the block G′ effectively adjusts or modifies the mechanism M to handle a lesser number of coins.

Finally, the coin mechanism M includes ratchet means R to stop forward movement of the transport bar B after the bar B has been moved rearwardly a sufficient distance to accept coinage deposited therein and to that position where the stop bars 35 and 36 on the bar B have moved rearwardly by the heads 40 on the latch arms A. The ratchet means R thereby serve to prevent one from withdrawing the bar and retrieving coinage therefrom after the coinage deposited therein has been accepted and the arm A has been moved to a position where it can actuate the item or product dispensing device of its related vending machine. Referring to FIG. 21 of the drawings, the means R includes the above noted recesses 37 and ratchet teeth 38 at the opposite sides of the transport bar B and further includes spring-loaded pawls 80 pivotally carried by the rear end portion of the top part of the frame F to normally extend into the front end portions of the recesses 37, forward of the ratchet teeth 38 and such that their inner ends will pivot forwardly in advance of and allow fo rearward movement of the ratchet teeth by them, upon rearward movement of the bar B but which lock with the teeth upon attempted forward movement of the bar B.

Upon full rearward movement of the row of ratchet teeth by the pawls, and upon subsequent forward movement of the bar B, the pawls reverse their engagement with the teeth as the teeth move by them and allow free forward movement of the bar B, but prevent reverse or rearward movement thereof. Accordingly, the bar B cannot be moved rearwardly to actuate its related product dispensing device subsequent to its being moved forwardly from its fully actuated position to its normal forward position. Accordingly, the ratchet means R effectively prevents "cheating" or improper cycling of its related item dispensing device, by manual reciprocation of the transport bar B throughout or within a portion of its operating travel.

In the form of the invention illustrated, the pawls are spring loaded by coil springs 81 engaged through openings in the pawls and engaged about the free ends of the anchor posts 48 at the ends of the legs 47 of the rat-trap spring 45, as clearly illustrated.

Referring to FIG. 23 of the drawings, it is to be particularly noted that the upper and lower edges of the coin C do not engage the bottom of the groove 63 in the caliper block 60 and the bottom of the trough 23 in the frame F, but rather, its opposite corner edges at the top and bottom of the coin engage and ride upon the inclined surfaces 64 and 24 of the groove and the trough (which surfaces converge radially outwardly relative to the central axis of the coin). With such a relationship of parts, if a coin which is of proper diameter but is too thick or too thin is engaged in the mechanism M, it will not enter its related groove and trough to a sufficient depth or will enter its related groove and trough to an excessive depth, either of which condition prevent movement of its related latch arm A to its intermediate operating position. It is important to note that similar results occur when a coin which is too large or too small is engaged in and between the groove and trough.

It is to be particularly noted that the angle of convergence of the coin engaging surfaces in the groove and in the trough greatly affects the distances coins of different thickness will enter the groove and trough. The less the angle of divergence of the related coin engaging surfaces of the groove and trough, the greater is the ratio of depth of engagement to thickness of coin. Accordingly, the inclined relationship of the coin engaging surfaces of the groove and trough multiply or amplify descrepancies in the thickness of coins measured thereby.

It is to be further noted that the two pairs of inclined coin engaging surfaces in the groove and trough double or compound measured differences in thickness of coins.

Finally, it is to be noted that the latch arms are elongate parts and that the caliper blocks are closely related to their forward pivotally mounted ends so that slight vertical movement of the blocks results in amplified and substantial vertical movement of the rear ends of the arms. In practice, it has been determined that vertical movement of the rear ends of the latch arms A should be at least four or preferably five times the vertical movement of the caliper blocks in order to attain dependable and satisfactory operation of the mechanism M.

It is to be noted that if the troughs and grooves function to double or triple measured differences in thickness of coins measured and the arms amplify such differences five times, the mechanism operates to amplify measured differences in coins ten or fifteen times. Accordingly, small differences which are likely to occur between genuine coins and slugs or the like, which persons might seek to feed into the mechanism, are readily detected by the mechanism.

In practice, if improper coinage is deposited in the mechanism and an effort is made to actuate it, the latch arms limit and prevent full actuation of the mechanism. In such a case, the mechanism does not prevent the bar B from being withdrawn to its normal forward position so that the person can manually withdraw the improper coinage.

It is to be noted that the transfer troughs 23, spring-loaded latch arms A and the caliper blocks 60 carried by the arms A cooperate to establish what is, in effect, spring-set outside caliper type measuring devices for coins and that the elongate latch arms are similar in nature to caliper dial arms that amplify measurements made by caliper type devices. Accordingly, the instant coin mechanism can be properly described, defined and/or classified as a caliper type coin mechanism.

The form of the invention described in the foregoing is particularly designed and is most effective to handle four like coins, such as four quarters. While it is possible to adjust the construction to handle one or more smaller coins, such as nickels and/or dimes, the adjustments required are so extensive that the effectiveness of the mechanism is likely to be adversely affected. Accordingly, in practice, it is desirable and considered good practice to design and construct special mechanisms to handle specific coinage, that is, specific combinations of different coins. In such cases, the number and sizes of the coin accommodating notches 21 in the frame flange 12 and the troughs 23 in the block portion of the bottom part 15 of the frame and the number and size of the tynes of the gate G are adjusted or varied to accommodate specific coinage. Otherwise, the construction remains essentially unchanged.

In furtherance of this invention and to most effectively alter, adjust or modify the coin mechanism to accommodate different combinations of different sizes of coins, the coin accommodating notches 21' at the flange 12 of the frame F are formed in a plate 90 which is removably set in an opening 91 formed in said flange of the frame. The plate 90 is provided with an orienting and retaining flange 92 which is set in a rearwardly opening recess 93 about the opening 91 in the flange 12, as clearly shown in FIGS. 25, 26 and 27 of the drawings. The plate 90 is releasably secured in place relative to the flange 12 by a fastener 94, substantially as shown.

To enable the plate 90 to be set in the opening 91 in the flange 12, the front end portions of the vertical walls 20 of the frame F are relieved, as indicated at 95.

In furtherance of the above and as shown in FIGS. 25, 26 and 28 of the drawings, the bottom part of the frame F is formed with an upwardly and rearwardly opening cavity 96 and a coin accommodating block 22 is arranged and set within the cavity. The Block 22' is formed with or defines the necessary and desired troughs 23''.

Each related set of notches 21' and troughs 23'' are formed and proportioned to accurately and most effectively accommodate a particular size coin and are cooperatively positioned with a predetermined one of the caliper blocks.

The gate G' in this form of the invention is specially formed to cooperate with the notches 21' and troughs 23'' and can be similar to the gate G' shown in FIG. 24 of the drawings.

With the above noted structure, it will be apparent that if the mechanism is provided with four caliper blocks and their related actuating means, special plates 90, blocks 22' and gates G can be provided to handle all different combinations of four or less coins which can be easily and conveniently engaged in and made a part of the mechanism, as circumstances require.

In accordance with the above, the mechanism can be altered or modified to handle different combinations of coins by simply inserting the appropriate plates 90, blocks 22' and gates G', each of which parts are small, light and very inexpensive to make.

In practice, and as shown at the left hand side of FIG. 29 of the drawings, it has been found that by increasing the lateral extent of the bottom of bottoms of one or more troughs 23 to closely accommodate the lower edges of two similar coins and by suitably spacing and proportioning the tynes of a related gate G, the trough or troughs and their related caliper blocks can be made to receive and effectively work on and with pairs of coins, as effectively as they can work with or on single coins. Accordingly, it is possible, if desired or if circumstances require, to double the coin capacity of any or all of the troughs of the coin mechanism.

When the structure is designed and formed to accommodate pairs of coins as shown at the left hand side of FIG. 29 of the drawings and improper coinage is engaged therein, as shown at the right hand side of FIG. 29 of the drawings, the caliper block 60 is not elevated sufficiently to effect actuation of the coin mechanism.

Having described only one typical preferred form and embodiment of my invention, I do not wish to be limited to the specific details herein set forth but wish to reserve to myself any modifications and/or variations that might appear to those skilled in the art and which fall within the scope of the following claims:

Having described my invention, I claim:

1. A coin mechanism comprising an elongate, horizontal frame with front, central and rear end portions, said frame has a mounting flange intermediate its ends and defines an elongate, upwardly and axially opening longitudinally extending channel and at least one elongate, longitudinally, rearwardly and upwardly opening coin edge receiving trough in its central portion below and between the sides of said channel; a flat, horizontal, elongate coin transport bar with front, central and rear end portions slidably engaged in the channel and manually shiftable longitudinally therein from a forward normal position to a rear actuated position, said bar has a vertical through opening in its central portion defining longitudinally spaced forwardly and rearwardly disposed coin edge engaging surfaces, said opening overlies the forward portion of the trough when the bar is in its normal position and is spaced rearward of the trough when the bar is in its actuated position; an elongate, horizontal latch arm with front and rear ends in vertical spaced substantially parallel relationship above the bar with its front end pivotally mounted to the frame on a transverse axis above the trough and the bar, said arm has upper and lower forwardly disposed latch shoulders at its rear end; said bar has vertically spaced stop shoulders normally spaced above and below the arm forward of the latch shoulders when the bar is in its normal position and spaced rearward of the latch shoulders when the bar is in its actuated position and on a substantially common transverse vertical plane with the latch shoulders when the bar is in an intermediate position; a part at the forward end portion of the arm defining an elongate, axially and downwardly opening coin edge receiving groove spaced above and opposite the rear end portion of the trough; means normally yieldingly holding the front end of the arm down relative to its pivotal axis with its lower latch shoulder positioned to establish stopped latched engagement with the lower stop shoulder when the bar is moved rearwardly to said intermediate position, said trough and groove are shaped and positioned so that upon engagement and rearward movement of a coin of predetermined thickness and diameter therein and therethrough, the coin pivots the arm upwardly so that its stop shoulders occur between vertically spaced horizontal planes between the upper and lower stop shoulders and such that if a coin which is too large in diameter and/or thickness is engaged therebetween, the coin pivots the arm upwardly so that its upper latch shoulder engages the upper stop shoulder when the bar is moved rearwardly to said intermediate position, the rear end of the bar contacts and operates a related product dispensing device when it is moved rearwardly from its intermediate position to its actuated position.

2. The coin mechanism set forth in claim 1 which further includes a longitudinally extending series of ratchet teeth and the bar and a spring loaded pawl carried by the frame and shiftable into and out of engagement with said teeth to stop forward movement of the bar when the bar is moved rearwardly from its intermediate position to its actuated position and to stop forward movement of the bar when the bar is moved forwardly from its actuated position to its intermediate position.

3. The coin mechanism set forth in claim 1 which further includes a coin orienting gate overlapping the through opening in the bar having a longitudinally extending slot on a common longitudinal vertical plane with said trough and groove to direct coins disposed on vertical planes parallel with the longitudinal axis of the bar into engagement in the trough and groove.

4. The coin mechanism set forth in claim 2 which further includes a coin orienting gate overlapping the trough opening in the bar and having a longitudinally extending slot on a common longitudinal vertical plaen with said trough and groove to direct coins disposed on vertical planes parallel with the longitudinal axis of the bar into engagement in the trough and groove.

5. The coin mechanism set forth in claim 1 wherein the trough has substantially opposing laterally upwardly and outwardly divergent surfaces to engage downwardly disposed edges of coins engaged in the trough and limiting the vertical distance the coins depend into the trough.

6. The coin mechanism set forth in claim 2 wherein the trough has substantially opposing laterally upwardly and outwardly divergent surfaces to engage downwardly disposed edges of coins engaged in the trough and limiting the vertical distance the coins depend into the trough.

7. The coin mechanism set forth in claim 3 wherein the trough has substantially opposing laterally upwardly and outwardly divergent surfaces to engage downwardly disposed edges of coins engaged in the trough and limiting the vertical distance the coins depend into the trough.

8. The coin mechanism set forth in claim 4 wherein the trough has substantially opposing laterally upwardly and outwardly divergent surfaces to engage downwardly disposed edges of coins engaged in the trough and limiting the vertical distance the coins depend into the trough.

9. The coin mechanism set forth in claim 1 wherein the groove in said part has substantially opposing laterally downwardly and outwardly divergent surfaces to engage upwardly disposed edges of coins engaged in the groove and limiting the vertical distance the coins project up into the groove.

10. The coin mechanism set forth in claim 2 wherein the groove in said part has substantially opposing laterally downwardly and outwardly divergent surfaces to engage upwardly disposed edges of coins engaged in the groove and limiting the vertical distance the coins project up into the groove.

11. The coin mechanism set forth in claim 3 wherein the groove in said part has substantially opposing laterally downwardly and outwardly divergent surfaces to engage upwardly disposed edges of coins engaged in the groove and limiting the vertical distance the coins project up into the groove.

12. The coin mechanism set forth in claim 4 wherein the groove in said part has substantially opposing laterally downwardly and outwardly divergent surfaces to engage upwardly disposed edges of coins engaged in the groove and limiting the vertical distance the coins project up into the groove.

13. The coin mechanism set forth in claim 5 wherein the groove in said part has substantially opposing laterally downwardly and outwardly divergent surfaces to engage upwardly disposed edges of coins engaged in the groove and limiting the vertical distance the coins project up into the groove.

14. The coin mechanism set forth in claim 6 wherein the groove in said part has substantially opposing laterally downwardly and outwardly divergent surfaces to engage upwardly disposed edges of coins engaged in the groove and limiting the vertical distance the coins project up into the groove.

15. The coin mechanism set forth in claim 7 wherein the groove in said part has substantially opposing laterally downwardly and outwardly divergent surfaces to engage upwardly disposed edges of coins engaged in the groove and limiting the vertical distance the coins project up into the groove.

16. The coin mechanism set forth in claim 8 wherein the groove in said part has substantially opposing laterally downwardly and outwardly divergent surfaces to engage upwardly disposed edges of coins engaged in the groove and limiting the vertical distance the coins project up into the groove.

17. The coin mechanism set forth in claim 16 wherein the part with said groove is a part carried by the arm and is shiftable vertically relative to the arm to set positions where it cooperatively engages coins of predetermined diameter and thickness selected from coins of different diameter and thickness and which are engaged in and move rearwardly through the trough upon engagement thereof through the opening in the bar and upon rearward movement of the bar from its normal to its actuated position.

18. The coin mechanism set forth in claim 8 wherein the part with said groove is a part carried by the arm and is shiftable vertically relative to the arm to set positions where it cooperatively engages coins of predetermined diameter and thickness selected from coins of different diameter and thickness and which are engaged in and move rearwardly through the trough upon engagement thereof through the opening in the bar and upon rearward movement of the bar from its normal to its actuated position.

* * * * *